US008498427B2

(12) United States Patent
Yang

(10) Patent No.: US 8,498,427 B2
(45) Date of Patent: Jul. 30, 2013

(54) REMOTE CONTROL EARPHONE AND ELECTRONIC DEVICE USING THE SAME

(75) Inventor: Song-Ling Yang, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 330 days.

(21) Appl. No.: 13/097,090

(22) Filed: Apr. 29, 2011

(65) Prior Publication Data

US 2012/0163633 A1 Jun. 28, 2012

(30) Foreign Application Priority Data

Dec. 24, 2010 (CN) ..... 2010 1 0604407

(51) Int. Cl.
*H04R 1/00* (2006.01)

(52) U.S. Cl.
USPC ..... 381/74; 381/111; 381/309; 381/370; 381/384; 455/569.1; 455/575.2; 455/575.6; 379/430

(58) Field of Classification Search
USPC ..... 381/111, 74, 309, 370, 384, 375, 381/376, 122; 455/569.1, 575.2, 575.6; 379/430
See application file for complete search history.

(56) References Cited

U.S. PATENT DOCUMENTS 8,260,380 B2 * 9/2012 Kim ..... 455/575.2

* cited by examiner

*Primary Examiner* — Vivian Chin
*Assistant Examiner* — Paul Kim
(74) *Attorney, Agent, or Firm* — Altis Law Group, Inc.

(57) ABSTRACT

The present disclosure provides an electronic device with a remote control earphone electrically connected to the main body of the device. The remote control earphone includes seven sensing units, which are substantially arranged in a "8" shape. Sensing signal generated by each sensing unit in response to a touch from the user includes an identification code for identifying itself. The remote control earphone transmits the generated sensing signal to the main body. The main body includes a cache unit to store at least one identification code corresponding to the sensing signal, a storage unit to store the relationship between the identification codes and numbers the identification codes corresponding to, and a processing unit to determine which one of the numbers is input according to the at least one identification code and the relationship.

10 Claims, 4 Drawing Sheets

REMOTE CONTROL EARPHONE AND ELECTRONIC DEVICE USING THE SAME

BACKGROUND

1. Technical Field

The present disclosure relates to remote control earphones and, more particularly, to a remote control earphone capable of being employed to input numbers to an electronic device using the remote control earphone.

2. Description of Related Art

Remote control earphones capable of controlling electronic devices using the earphones are well known. For example, a remote control earphone of a mobile phone can be employed to answer or dial a call. However, traditional remote control earphones cannot be employed to input numbers to electronic devices, which may not bring the convenience of the traditional remote control earphones to a desirable level.

It is therefore desirable to provide a remote control earphone and an electronic device using the remote control earphone to solve the problem mentioned above.

BRIEF DESCRIPTION OF THE DRAWINGS

The components in the drawings are not necessarily drawn to scale, the emphasis instead being placed upon clearly illustrating the principles of the present disclose. Moreover, in the drawings, like reference numerals designate corresponding parts throughout the several views.

DETAILED DESCRIPTION

The disclosure is illustrated by way of example and not by way of limitation. It should be noted that references to "an" or "one" embodiment in this disclosure are not necessarily to the same embodiment, and such references mean at least one.

Figure 1:
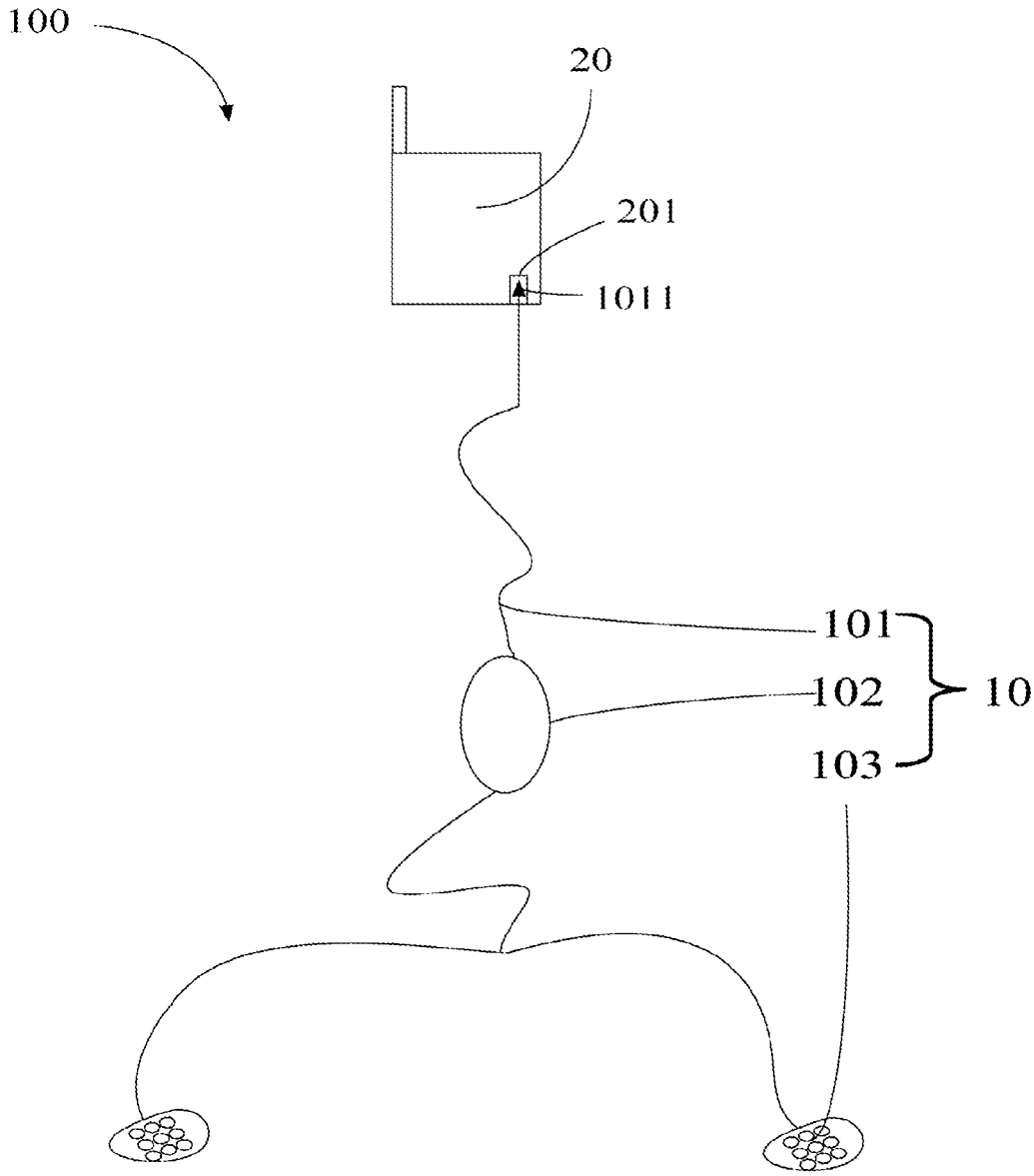
FIG. 1 is a schematic view of an electronic device with a remote control earphone, in accordance with an exemplary embodiment.

Referring to FIG. 1, an electronic device 100 includes a main body 20 and a remote control earphone 10 electrically connected to the main body 20. The main body 20 may be an electronic device (e.g., a mobile phone, or a music player) having an earphone socket 201. The remote control earphone 10 can be used to control the main body 20 to execute different operations, for example answering or dialing a call. The remote control earphone 10 includes a wire 101, a control 102, and an earphone 103. In this embodiment, the wire 101 includes an earphone plug 1011 matching the earphone socket 201. The earphone 103 is electrically connected to the control 102 through the wire 101. The control 102 is electrically connected to the main body 20 when the earphone plug 1011 is inserted into the earphone socket 201. The control 102 is used to input information to the main body 20. In this embodiment, the main body 20 is a mobile phone.

Figure 2:
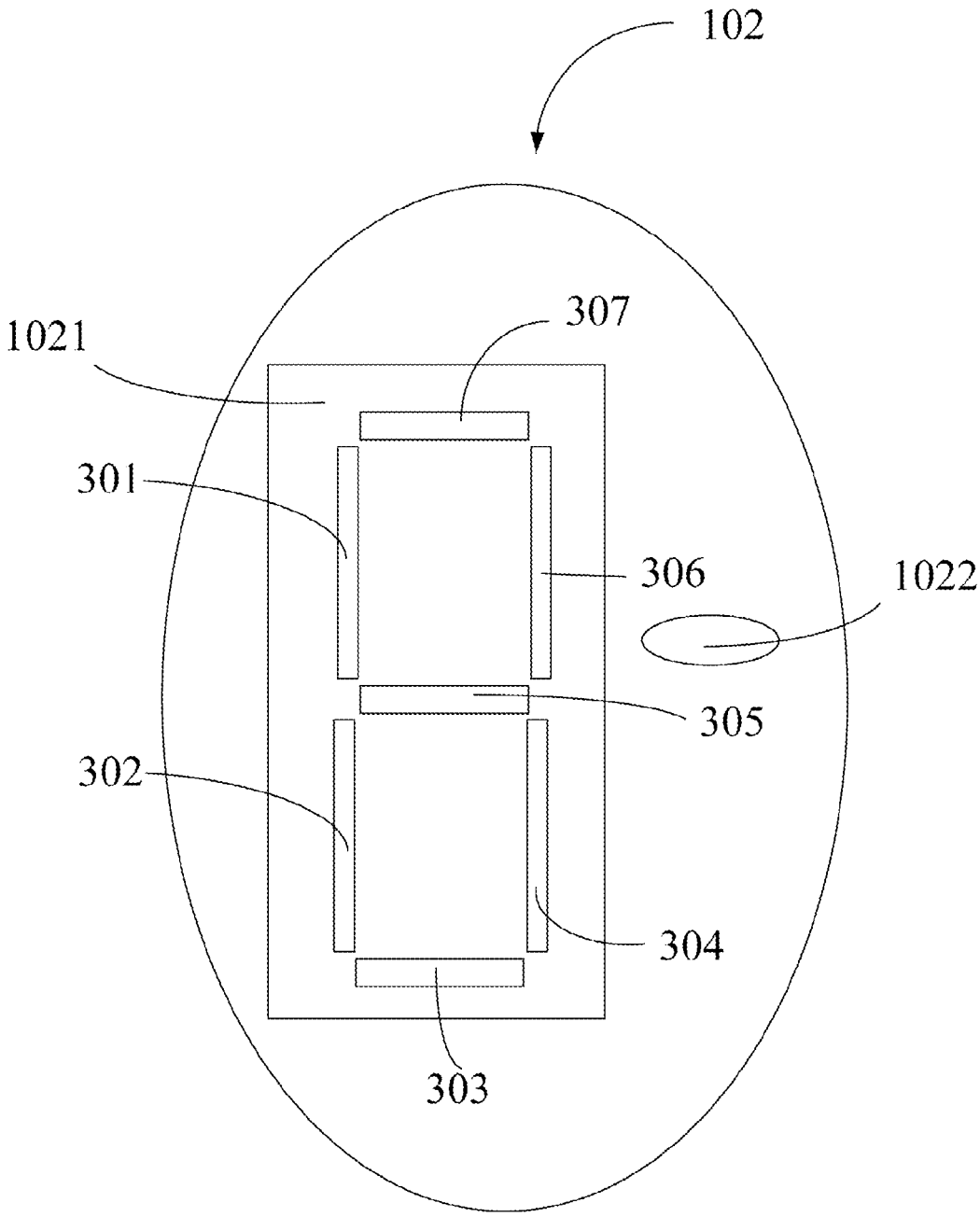
FIG. 2 is a schematic view of a control of the remote control earphone of FIG. 1 in accordance with an exemplary embodiment.

Referring to FIG. 2, the control 102 includes a number input area 1021 for inputting numbers to the main body 20. In this embodiment, the control 102 further includes at least one button 1022 for users to control the input operation on the number input area 1021, such as to cancel current operation or to confirm current operation. When the at least one button 1022 is pressed, a cancel signal or a confirmation signal is formed and transmitted to the main body 20 to cancel or confirm the current operation.

The number input area 1021 includes seven sensing units 301-307, which are substantially arranged in a "8" shape. Each of the seven sensing units 301-307 generates a sensing signal in response to a touch from the user. The sensing signal generated by each of the seven sensing units 301-307 includes an identification code for identifying itself. The remote control earphone 10 transmits the generated sensing signal to the main body 20. In this embodiment, the identification codes of the sensing units 301-307 are respectively A01, A02, A03, A04, A05, A06, and A07.

Figure 3:
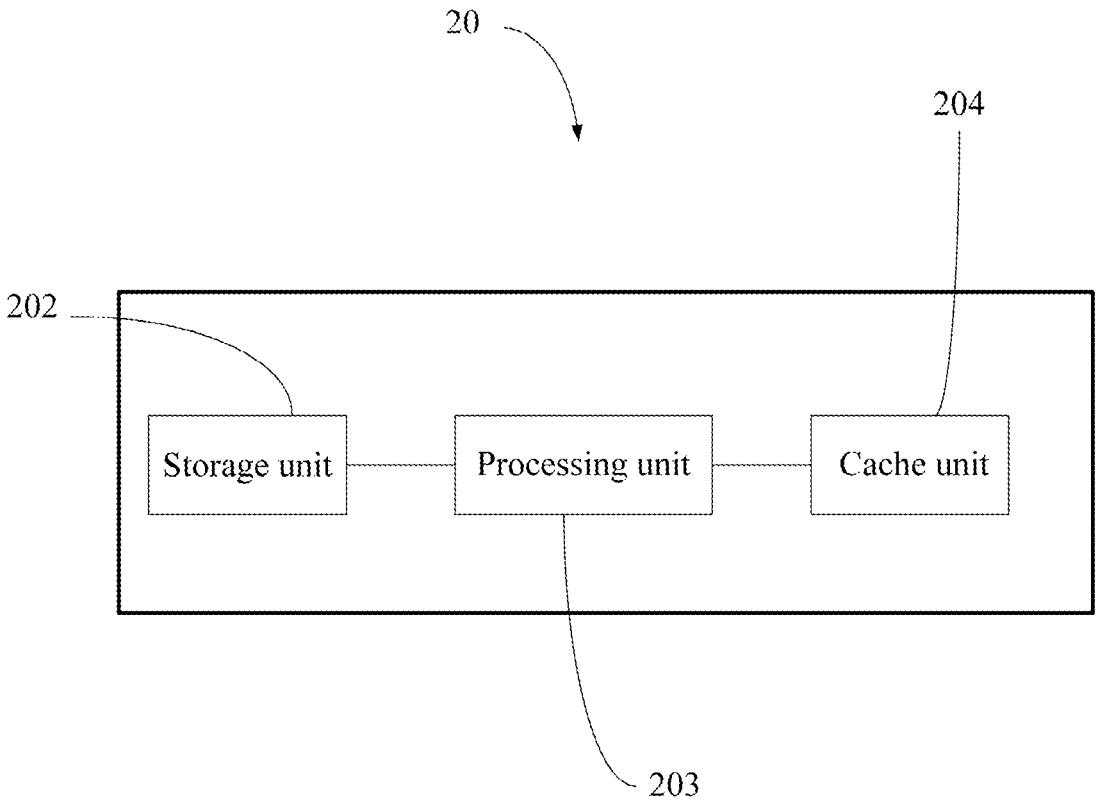
FIG. 3 is a block diagram of a main body of the electronic device of FIG. 1 in accordance with an exemplary embodiment.

Referring to FIG. 3, the main body 20 includes a storage unit 202, a processing unit 203, and a cache unit 204. The storage unit 202 stores the relationship between the identification codes of the seven sensing units 301-307 and numbers the identification codes corresponding to. In this embodiment, the relationship is recorded in a table 1 as shown below.

TABLE 1

| Identification codes | Input number |
|---|---|
| A01 ` A02 ` A03 ` A04 ` A06 ` A07 | 0 |
| A04 ` A06 | 1 |
| A02 ` A03 ` A05 ` A06 ` A07 | 2 |
| A03 ` A04 ` A05 ` A06 ` A07 | 3 |
| A01 ` A04 ` A05 ` A06 | 4 |
| A01 ` A03 ` A04 ` A05 ` A07 | 5 |
| A01 ` A02 ` A03 ` A04 ` A05 | 6 |
| A04 ` A06 ` A07 | 7 |
| A01 ` A02 ` A03 ` A04 ` A05 ` A06 ` A07 | 8 |
| A01 ` A03 ` A04 ` A05 ` A06 ` A07 | 9 |

The cache unit 204 is configured to store at least one identification code corresponding to the generated sensing signal. The processing unit 203 is configured to determine which one of the numbers is input according to the at least one identification code stored in the cache unit and the relationship after an input operation is finished.

In this embodiment, the processing unit 203 determines the identification code of the touched sensing unit according to sensing signal generated by the touched sensing unit and stores the determined identification code in the cache unit 204. The processing unit 203 further determines an input number according to the at least one identification code stored in cache unit 204 and the relationship when determining that an input operation has finished, and erases the cache unit 204 to wait to receive the next identification code. In this embodiment, the processing unit 203 determines that an input operation is finished when a duration of not receiving a sensing signal exceeds a predetermined interval or when a confirmation signal from the at least one button 1022 is received. The processing unit 203 deletes a current input number when cancel signal from the at least one button 1022 is received. If the processing unit 203 determines that a number cannot be determined according to the at least one identification code stored in the cache unit 204 after an input operation is finished, the processing unit 203 also erases the cache unit 204.

The following example is given to better illustrate the present disclosure. When receiving the sensing signal generated by the sensing unit 303, the processing unit 203 determines the identification code A03 of the sensing unit 303 and stores the identification code A03 in the cache unit 204. The processing unit 203 also stores the A04, A05, A06, and A07 in the cache unit 204 when the sensing units 304, 305, 306 and 307 are sequentially touched. When determining the input operation has finished, the processing unit 203 determines that a number 3 is input, and clears the cache unit 204.

When the processing unit 203 determines that a number is successfully input, the processing unit 203 further generates a voice prompt to prompt that a certain number has been input. Therefore, during the dialing of a call, the users can directly input numbers representing a telephone number through the remote control earphone 10 instead of operating on the main body 20.

Figure 4:
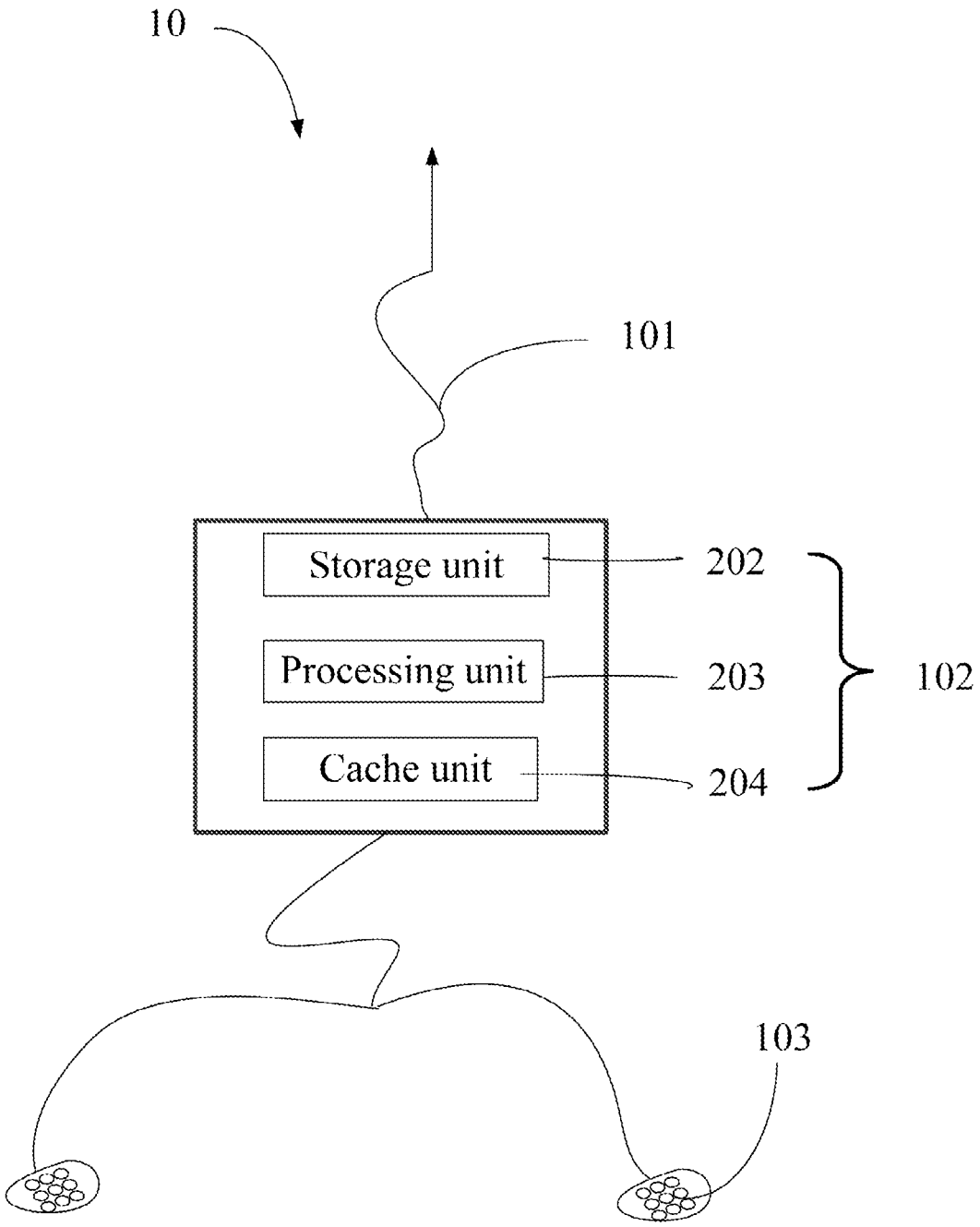
FIG. 4 is a schematic diagram of a remote control earphone in accordance with an another exemplary embodiment.

Referring to FIG. 4, in another embodiment, the storage unit 202, the processing unit 203, and the cache unit 204 are disposed in the control 102 of the remote control earphone 10. The functions of the storage unit 202, the processing unit 203, and the cache unit 204 are the same as that of FIG. 1, so the description is omitted.

Although the present disclosure has been specifically described on the basis of the exemplary embodiment thereof, the disclosure is not to be construed as being limited thereto. Various changes or modifications may be made to the embodiment without departing from the scope and spirit of the disclosure.

What is claimed is:

1. An electronic device comprising:

a main body; and a remote control earphone electrically connected to the main body, comprising:

a control configured to control the main body to execute operation, comprising:

a number input area comprising seven sensing units which are substantially arranged in a "8" shape, wherein a sensing signal generated by each of the seven sensing units in response to a touch from a user comprises an identification code for identifying itself, and the remote control earphone transmits the sensing signal to the main body;

the main body comprising:

a storage unit configured to store the relationship between the identification codes of the seven sensing units and numbers the identification codes corresponding to;

a cache unit configured to store at least one identification code corresponding to the sensing signal; and a processing unit configured to determine which one of the numbers is input according to the at least one identification code stored in the cache unit and the relationship after an input operation is finished.

2. The electronic device as described in claim 1, wherein the processing unit determines the identification code of a touched sensing unit according to sensing signal generated by the touched sensing unit and stores the determined identification code in the cache unit, and further determines an input number according to at least one identification code stored in the cache unit when determining that an input operation has finished, and erases the cache unit.

3. The electronic device as described in claim 2, wherein the processing unit determines that an input operation has finished when a duration of not receiving a sensing signal exceeds a predetermined interval.

4. The electronic device as described in claim 1, wherein the control further comprises at least one button for users to control the input operation on the number input area, and the at least one button is capable of generating cancel signal, and when the processing unit receives the cancel signal, the processing unit deletes a current input number.

5. The electronic device as described in claim 1, wherein the control further comprises at least one button for users to control the input operation on the number input area, and the at least one button is capable of generating confirmation signal, and when the processing unit receives the confirmation signal, the processing unit determines that an input operation has finished.

6. The electronic device as described in claim 1, wherein when the processing unit determines that a number cannot be determined according to the at least one identification code stored in the cache unit after an input operation has finished, the processing unit erases the cache unit.

7. The electronic device as described in claim 1, wherein when the processing unit determines that a number is successfully input, the processing unit generates a voice prompt to prompt that a certain number has been input.

8. A remote control earphone comprising:

a number input area comprising seven sensing units which are substantially arranged in a "8" shape, wherein a sensing signal generated by each of the seven sensing units in response to a touch from a user comprises an identification code for identifying itself;

a storage unit configured to store the relationship between the identification codes of the seven sensing units and numbers the identification codes corresponding to;

a cache unit configured to store at least one identification code corresponding to the sensing signal, and a processing unit configured to determine which one of the numbers is input according to the at least one identification code stored in the cache unit and the relationship after an input operation has finished and transmit electronic signal corresponding to the input number to an external electronic device electrically connected to the remote control earphone.

9. The remote control earphone as described in claim 8 further comprising at least one button for users to control input operation, and the at least one button is capable of generating cancel signal, and when the processing unit receives the cancel signal, the processing unit deletes a current input number.

10. The remote control earphone as described in claim 8 further comprising at least one button for users to control input operation, and the at least one button is capable of generating confirmation signal, and when the processing unit receives the confirmation signal, the processing unit determines that an input operation is finished.

* * * * *